US011236476B2

(12) United States Patent
Yamamoto et al.

(10) Patent No.: US 11,236,476 B2
(45) **Date of Patent: *Feb. 1, 2022**

(54) MAGNETIC MARKER INSTALLATION METHOD

(71) Applicant: AICHI STEEL CORPORATION, Tokai (JP)

(72) Inventors: Michiharu Yamamoto, Tokai (JP); Tomohiko Nagao, Tokai (JP); Hitoshi Aoyama, Tokai (JP)

(73) Assignee: AICHI STEEL CORPORATION, Tokai (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/972,023

(22) PCT Filed: May 21, 2019

(86) PCT No.: PCT/JP2019/020184

§ 371 (c)(1),
(2) Date: Dec. 4, 2020

(87) PCT Pub. No.: WO2019/239825

PCT Pub. Date: Dec. 19, 2019

(65) Prior Publication Data

US 2021/0230822 A1 Jul. 29, 2021

(30) Foreign Application Priority Data

Jun. 11, 2018 (JP) ..... JP2018-111406

(51) Int. Cl.
*E01F 11/00* (2006.01)
*G08G 1/042* (2006.01)

(52) U.S. Cl.
CPC ..... *E01F 11/00* (2013.01); *G08G 1/042* (2013.01)

(58) Field of Classification Search
CPC ..... E01F 11/00; E01F 9/30; G03G 9/0835; G08G 1/042
See application file for complete search history.

(56) References Cited

U.S. PATENT DOCUMENTS 1,791,997 A * 2/1931 Benton ..... E01F 13/105 246/128
1,803,292 A * 4/1931 Adler, Jr. ..... G08G 1/042 340/905

(Continued)

FOREIGN PATENT DOCUMENTS

JP 2005-202478 A 7/2005
JP 2006-195873 A 7/2006

(Continued)

OTHER PUBLICATIONS

Use of Radio Frequency Identification Tags in Pavements https://www.fhwa.dot.gov> infrastructure > pavement PDF by CW Schwartz 2014.*

(Continued)

*Primary Examiner* — Qutbuddin Ghulamali
(74) *Attorney, Agent, or Firm* — Renner, Otto, Boisselle & Sklar, LLP

(57) ABSTRACT

To install, in or on a road surface of a road, a magnetic marker having retained in its outer perimeter an RFID tag including an antenna for wireless communication, an arrangement step of accommodating the magnetic marker in an accommodation hole provided to be bored in the road surface and a formation step of providing the magnetic marker with a protecting part for isolating the antenna from water are performed. With these steps, even if the periphery of the magnetic marker is submerged in water after installation, high communication performance of the RFID tag can be kept.

8 Claims, 21 Drawing Sheets

(56) References Cited

U.S. PATENT DOCUMENTS

| | | | | | |
|---|---|---|---|---|---|
| 3,609,678 | A * | 9/1971 | Fayling | G08G 1/096783 | 340/905 |
| 5,408,179 | A * | 4/1995 | Sampey | G01V 3/087 | 324/253 |
| 5,853,846 | A * | 12/1998 | Clark | B32B 5/16 | 428/131 |
| 6,468,678 | B1 * | 10/2002 | Dahlin | E01F 9/30 | 180/167 |
| 2002/0149493 | A1 * | 10/2002 | Yudate | E01F 9/30 | 340/693.5 |
| 2019/0098468 | A1 * | 3/2019 | Yamamoto | G08G 1/042 | |
| 2019/0155305 | A1 | 5/2019 | Yamamoto | | |
| 2019/0194886 | A1 | 6/2019 | Yamamoto | | |

FOREIGN PATENT DOCUMENTS

| | | | |
|---|---|---|---|
| JP | 2017-162463 | A | 9/2017 |
| JP | 2017-224236 | A | 12/2017 |
| WO | 2017/187879 | A1 | 11/2017 |

OTHER PUBLICATIONS

International Search Report for corresponding Application No. PCT/JP2019/020184, dated Jul. 30, 2019.

* cited by examiner

[FIG.1]
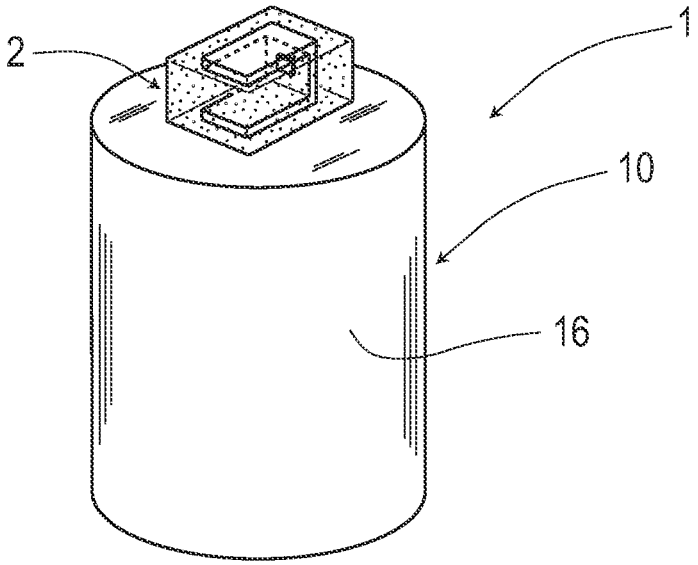

[FIG.2]
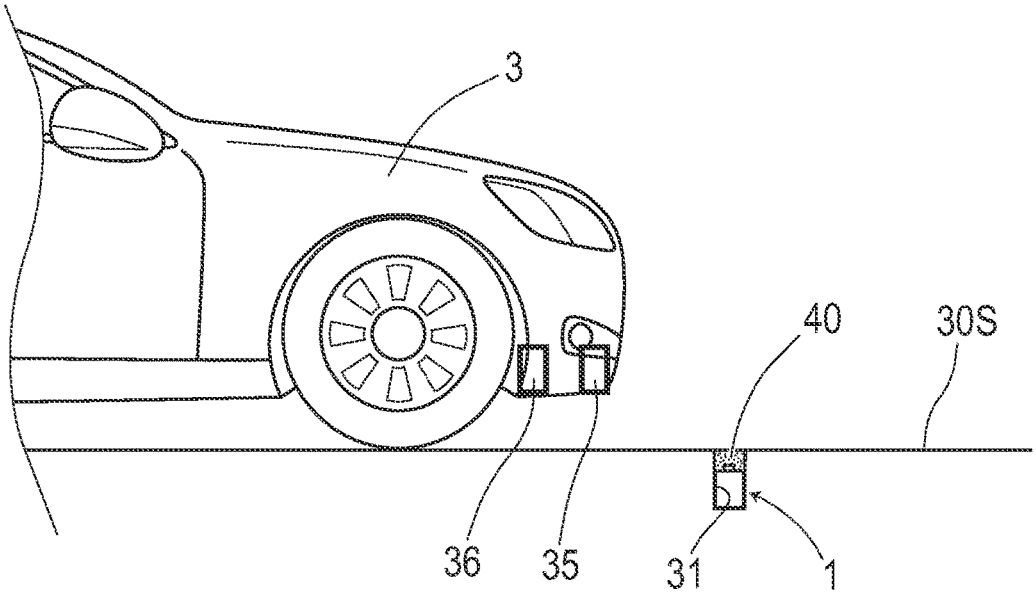

[FIG.3]
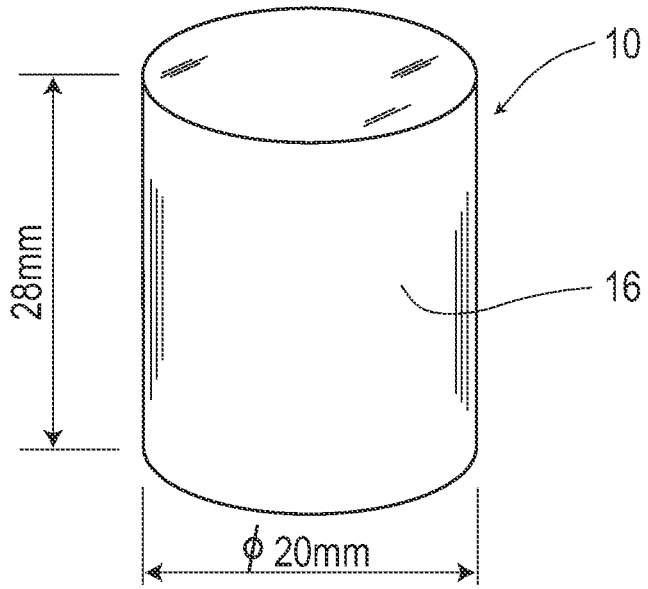

[FIG.4]
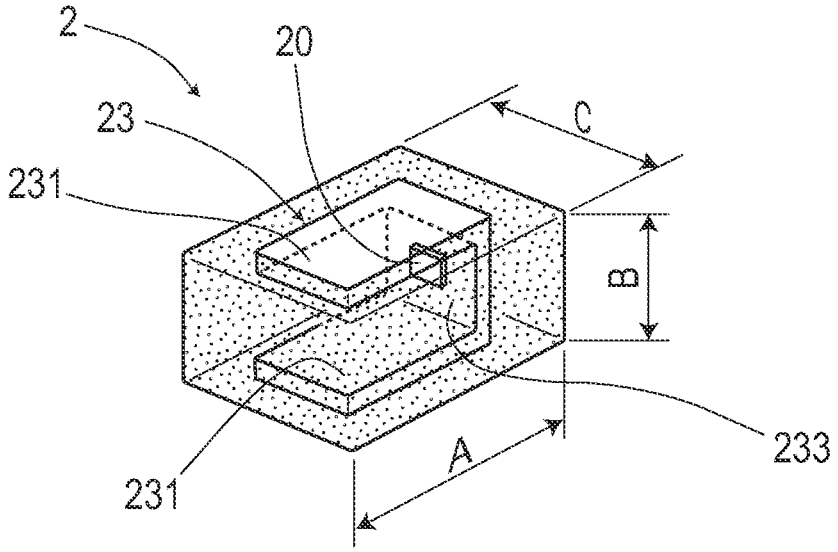

[FIG.5]
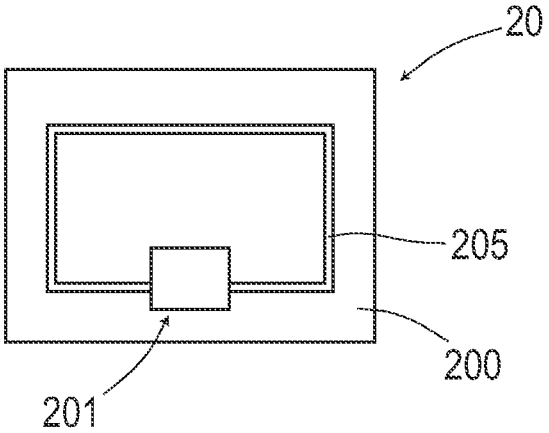

[FIG.6]
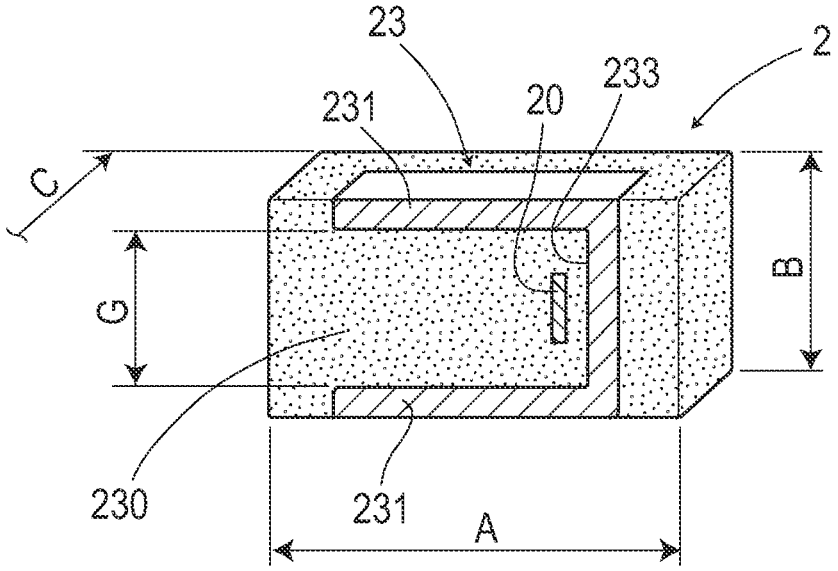

[FIG.7]
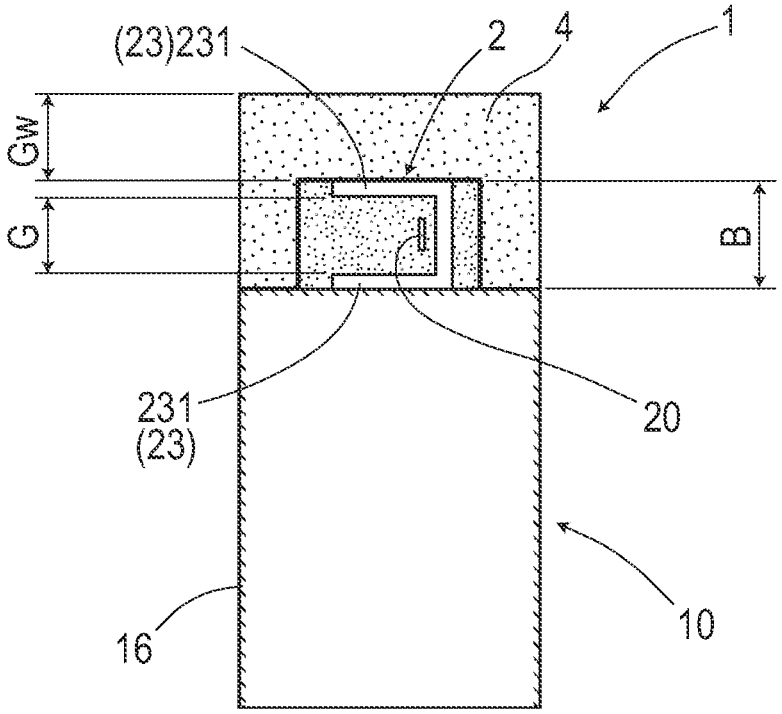

[FIG.8]

| | | Gw (mm) | | | | | | | |
|---|---|---|---|---|---|---|---|---|---|
| | | 1 | 2 | 3 | 4 | 5 | 6 | 7 | 8 |
| G (mm) | 3 | B | B | A | A+ | A+ | A+ | A+ | A+ |
| | 4 | B | B | A- | A | A+ | A+ | A+ | A+ |
| | 5 | B | B | B | B | A | A+ | A+ | A+ |
| | 6 | B | B | B | B | A- | A | A+ | A+ |

[FIG.9]
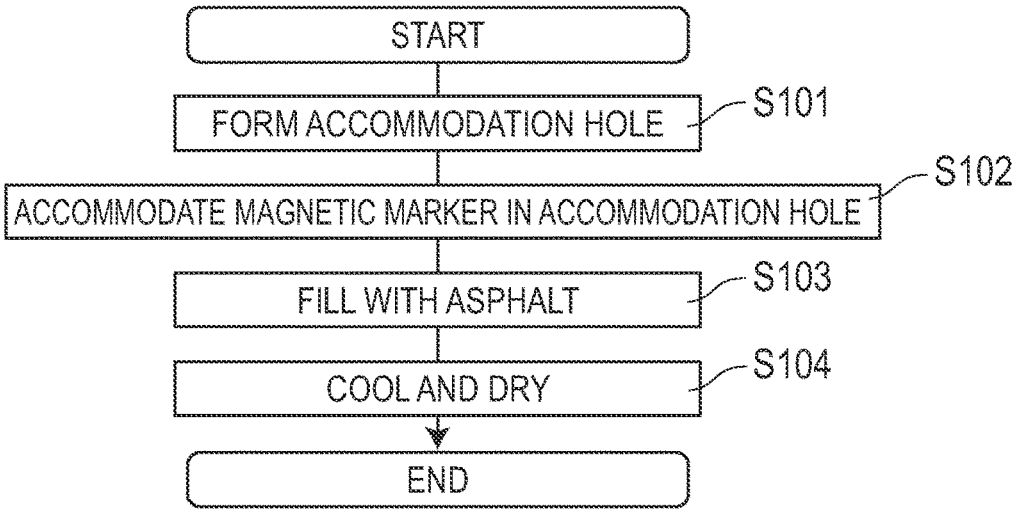

[FIG.10]
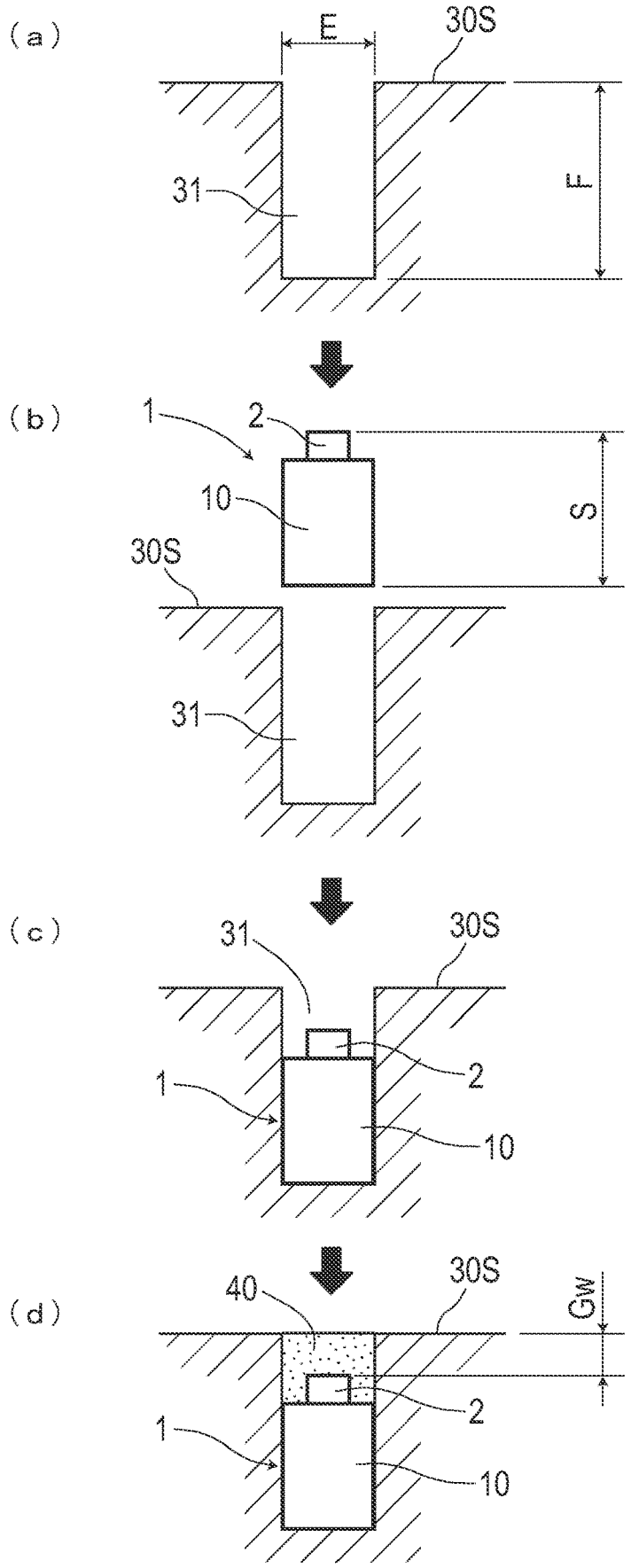

[FIG.11]
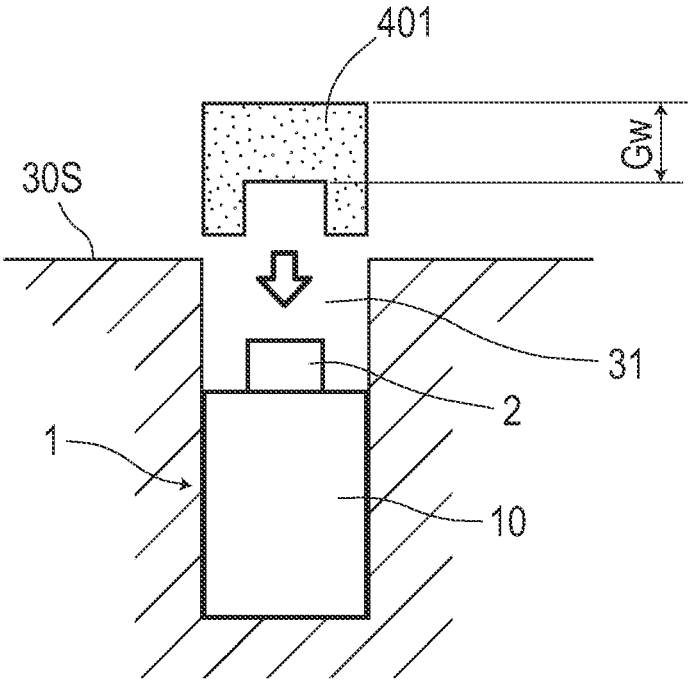

[FIG.12]
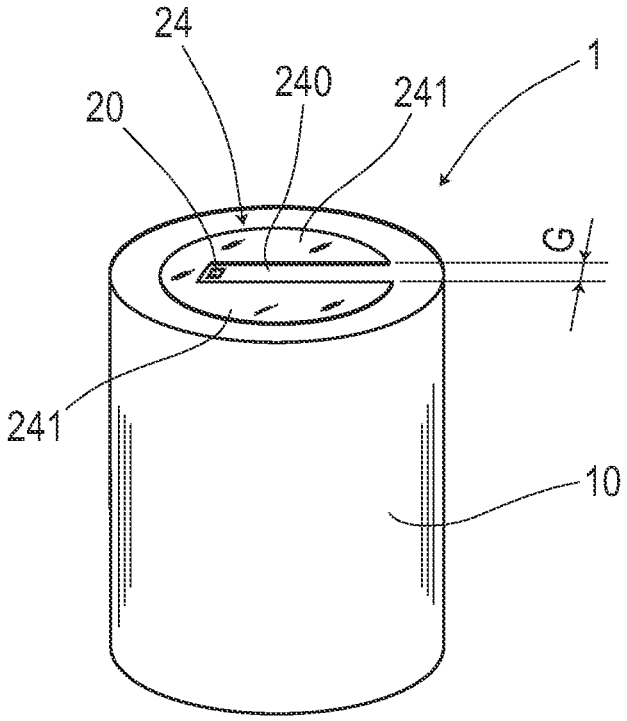

[FIG.13]
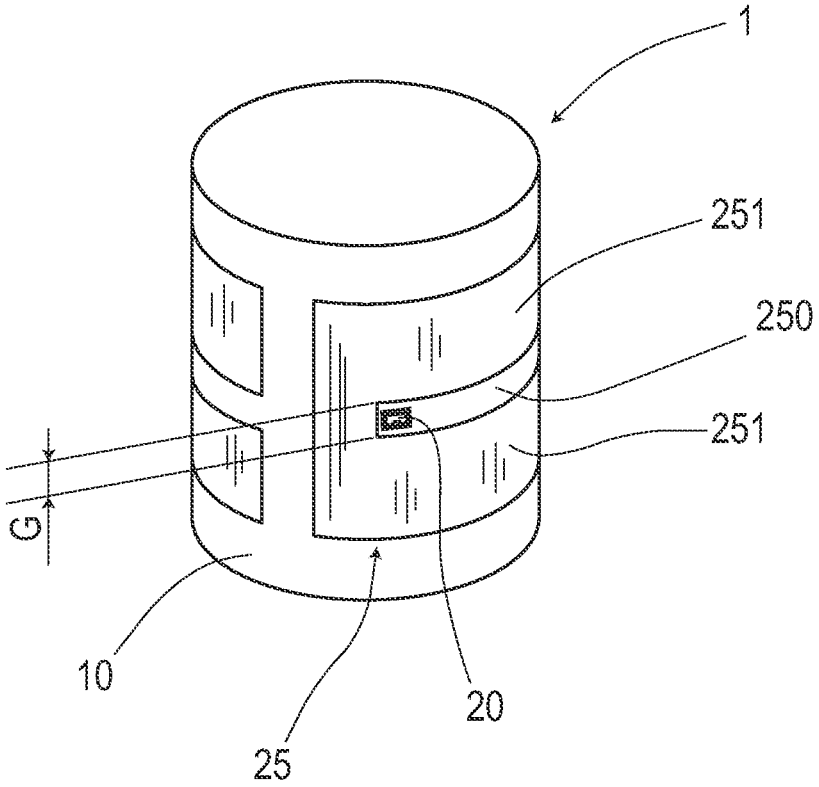

[FIG.14]
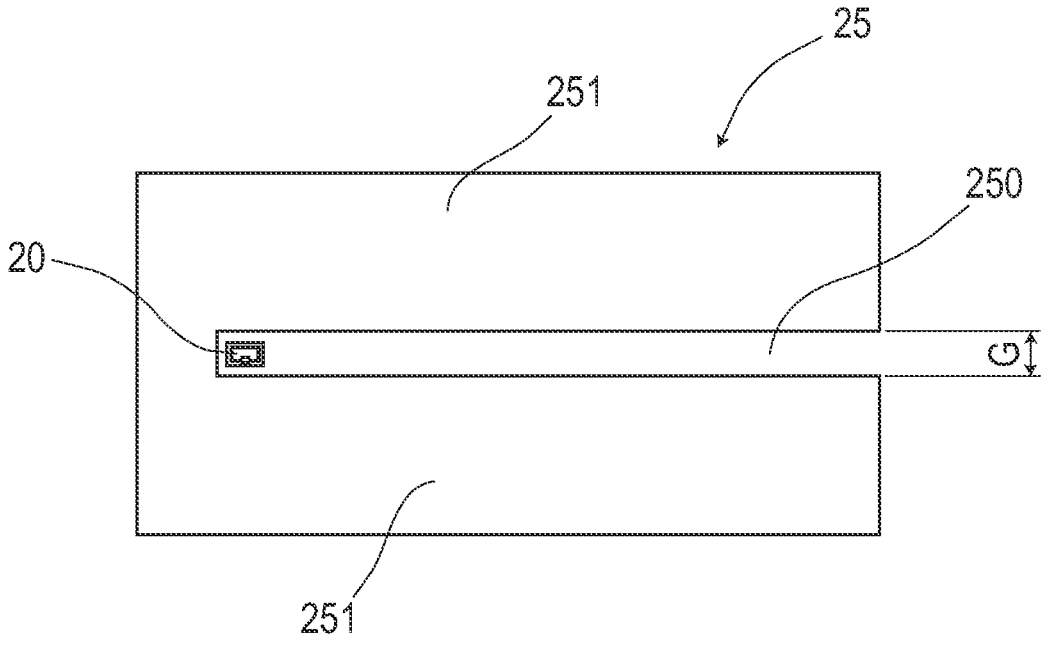

[FIG.15] (a)
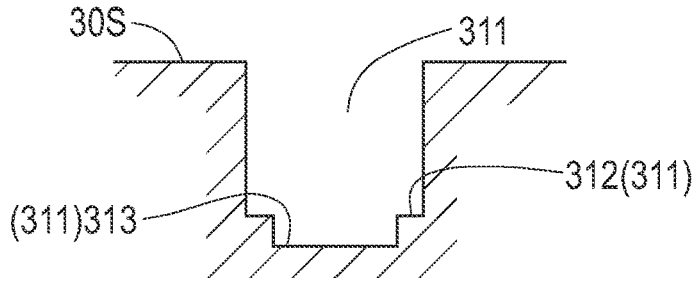
(b)
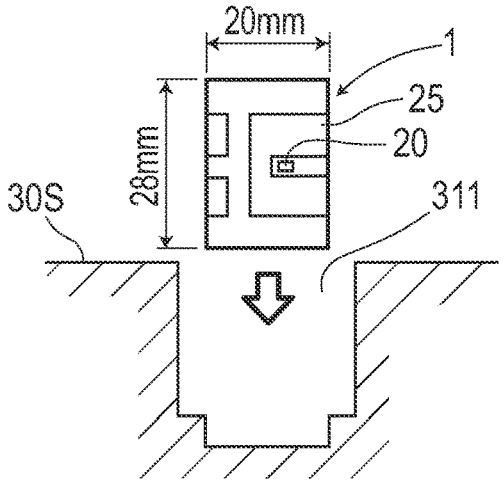
(c)
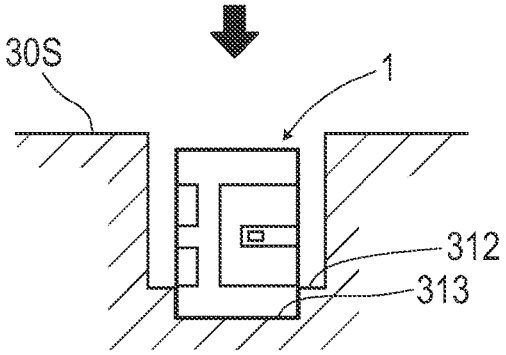
(d)
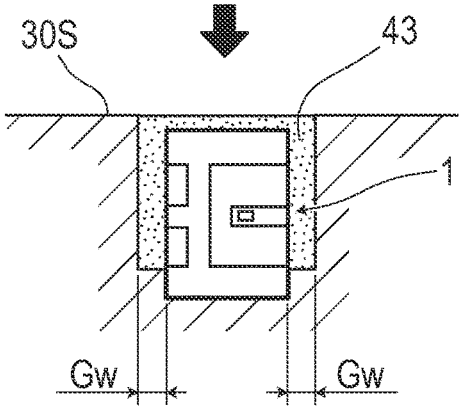

[FIG.16]
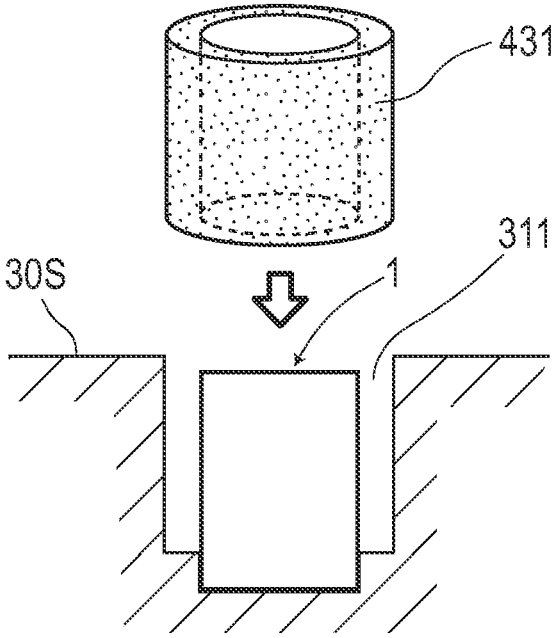

[FIG.17]
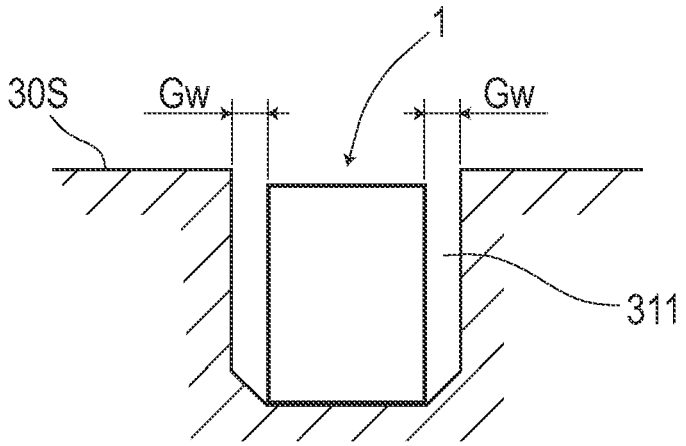

[FIG.18]
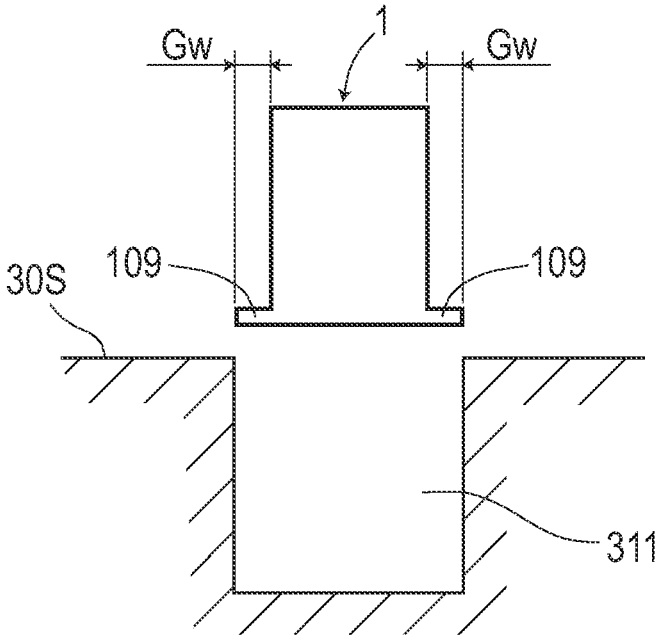

[FIG.19]
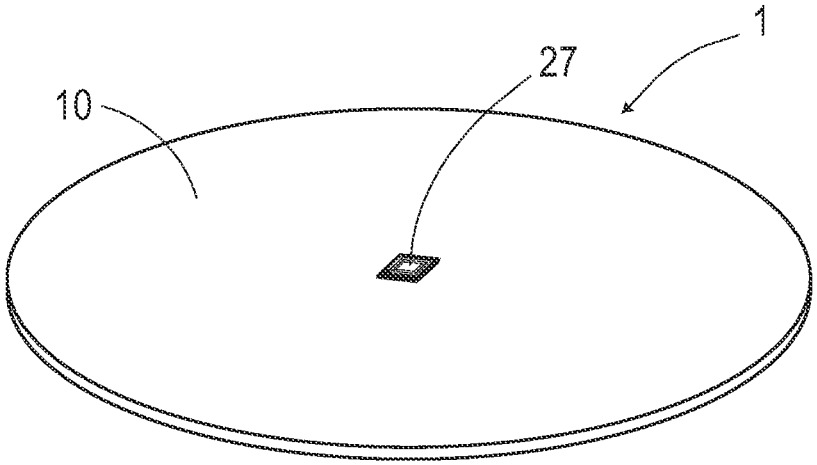

[FIG.20]
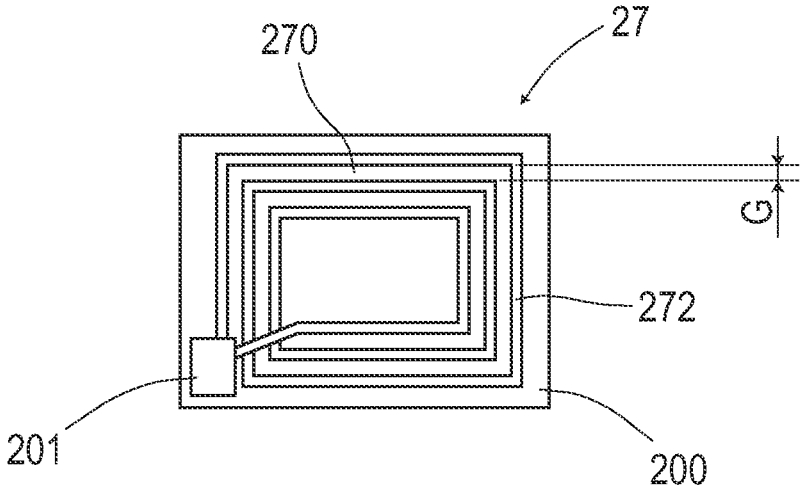

[FIG.21]
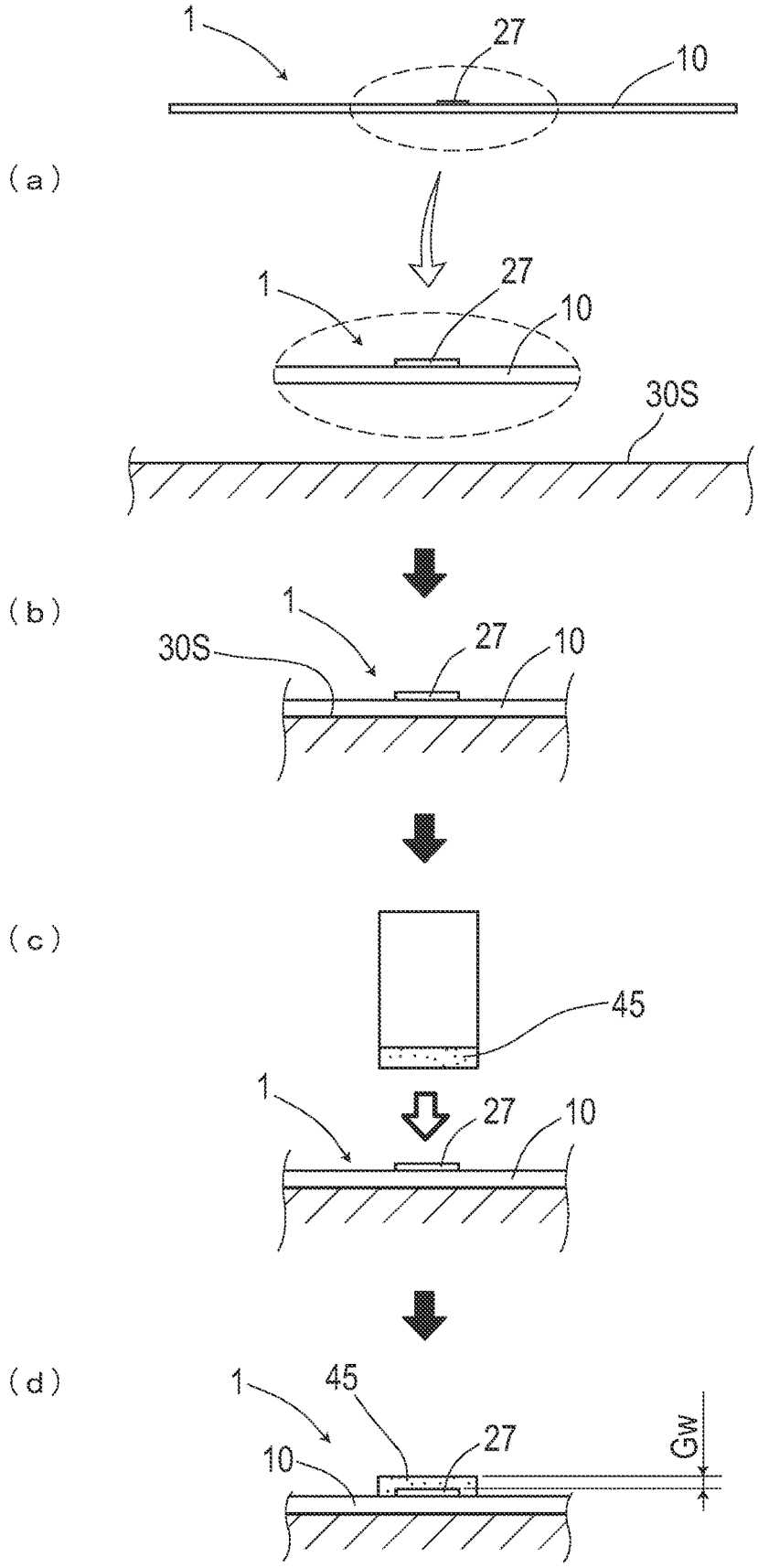

MAGNETIC MARKER INSTALLATION METHOD

TECHNICAL FIELD

The present invention relates to a method of installing a magnetic marker to be laid in or on a road.

BACKGROUND ART

Conventionally, magnetic markers to be laid in a road so as to be detectable by a vehicle side have been known (for example, refer to Patent Literature 1). If the magnetic markers are utilized, there is a possibility of achieving automatic driving as well as various driving assists such as, for example, automatic steering control and lane departure warning by using the magnetic markers laid along a lane.

However, there is a problem that information that can be acquired by detecting a magnetic marker includes information about presence or absence of the magnetic marker, a shift amount in a width direction of a vehicle with respect to the magnetic marker, whether magnetic polarity indicates the N pole or the S pole, and so forth, and the amount and types of information that can be acquired from a magnetic marker side are not sufficient. Thus, the applicant of the present application has suggested a magnetic marker including an information providing part such as an RFID tag (refer to Patent Literature 2).

CITATION LIST

Patent Literature

Patent Literature 1: Japanese Unexamined Patent Application Publication No. 2005-202478

Patent Literature 2: WO2017/187879

SUMMARY OF INVENTION

Technical Problem

With the magnetic marker including the information providing part as described above, the problem that the amount of information is not sufficient can be solved, and more information can be provided to the vehicle side by using wireless communication. However, in the event of rain or the like in which there is a possibility that a periphery of the magnetic marker may be submerged in water, stability of the wireless communication may be impaired due to influences of water exhibiting electromagnetic characteristics that attenuate electric waves. In particular, this problem may occur significantly when the UHF band is applied to the information providing part.

The present invention was made in view of the above-described conventional problem, and is to provide a method of installing a magnetic marker so that more information can be stably provided.

Solution to Problem

The present invention is an invention regarding an installation method for laying, in or on a road, a magnetic marker having retained therein a wireless tag including an antenna for wireless communication. The magnetic marker installation method according to the present invention includes an arrangement step of arranging the magnetic marker in or on the road and a formation step of providing the magnetic marker with a protecting part for isolating the antenna from water.

Advantageous Effects of Invention

With the magnetic marker including the wireless tag, more information can be provided to a vehicle side by using wireless communication. On the other hand, in the event of rain or the like in which there is a possibility that a periphery of the magnetic marker is submerged in water, stability of wireless communication may be impaired due to influences of water exhibiting electromagnetic characteristics which attenuate electric waves.

To address this, the magnetic marker installation method of the present invention includes the formation step of providing the protecting part which isolates the antenna from water. By installing the magnetic marker with the installation method including the formation step of providing the protecting part, even if water is present on the periphery of the magnetic marker in the event of rain, for example, it is possible to reduce a possibility of impairing reliability of wireless communication.

As described above, according to the magnetic marker installation method of the present invention, the magnetic marker can be installed so that more information can be stably provided to the vehicle side.

BRIEF DESCRIPTION OF DRAWINGS

FIG. 1 is a diagram depicting a magnetic marker in a first embodiment.

FIG. 2 is a descriptive diagram exemplarily depicting a state in which a vehicle detects the magnetic marker in the first embodiment.

FIG. 3 is a diagram depicting a magnet configuring the magnetic marker in the first embodiment.

FIG. 4 is a perspective view of an RFID tag in the first embodiment.

FIG. 5 is a front view of a tag in the first embodiment.

FIG. 6 is a sectional view depicting an inner structure of the RFID tag in the first embodiment.

FIG. 7 is a diagram depicting a cross-sectional structure of the magnetic marker used in an evaluation test of communication performance in the first embodiment.

FIG. 8 is a diagram exemplarily depicting results of evaluation of communication performance in the first embodiment.

FIG. 9 is a flow chart diagram depicting a magnetic marker installation procedure in the first embodiment.

FIG. 10 is a descriptive diagram of the magnetic marker installation procedure in the first embodiment.

FIG. 11 is a descriptive diagram of another magnetic marker installation procedure in the first embodiment.

FIG. 12 is a perspective view depicting another magnetic marker in the first embodiment.

FIG. 13 is a perspective view depicting the magnetic marker in a second embodiment.

FIG. 14 is a development view of a metal foil in the second embodiment.

FIG. 15 is a descriptive diagram of the magnetic marker installation procedure in the second embodiment.

FIG. 16 is a descriptive diagram of another magnetic marker installation procedure in the second embodiment.

FIG. 17 is a diagram depicting another accommodation hole in the second embodiment.

FIG. 18 is a diagram depicting another magnetic marker in the second embodiment.

FIG. 19 is a diagram depicting a sheet-shaped magnetic marker in a third embodiment.

FIG. 20 is a diagram depicting the RFID tag in the third embodiment.

FIG. 21 is a descriptive diagram of a sheet-shaped magnetic marker installation procedure in the third embodiment.

DESCRIPTION OF EMBODIMENTS

Modes for implementation of the present invention are specifically described by using the following embodiments.

First Embodiment

The present embodiment is an example of a method of installing magnetic marker 1 including RFID tag (Radio Frequency IDentification Tag, wireless tag) 2. Details of this are described by using FIG. 1 to FIG. 12.

Magnetic marker 1 to be installed is, as in FIG. 1 and FIG. 2, a road marker arranged in road surface 30S, for example, along a center of a lane, for use in various vehicle controls, such as lane departure warning, a lane keep assist, and automatic driving. In this magnetic marker 1, RFID tag 2 which provides information by wireless communication is retained on one end face of columnar magnet 10.

With vehicle 3 (FIG. 2) equipped with magnetic sensor unit 35 which detects magnetism and tag reader unit 36 communicable with RFID tag 2, magnetic marker 1 can be magnetically detected during travel, and tag information can be acquired via wireless communication with RFID tag 2. Examples of the tag information include information indicating an absolute position, identification information of corresponding magnetic marker 1, road information such as intersections and branch roads, and so forth.

In the following, description is made to (1) a configuration of the magnetic marker as an installation target and, subsequently, (2) a magnetic marker installation method.

(1) Configuration of Magnetic Marker

Magnetic marker 1 has magnet 10 forming a main body as a magnetism generation source and RFID tag 2 attached around an outer peripheral surface of magnet 10. Following description of magnet 10 and RFID tag 2, description is made to magnetic marker 1 with both of them combined together.

(Magnet)

Magnet 10 (FIG. 3) is an isotropic ferrite plastic magnet or a ferrite rubber magnet, made with magnetic powder of iron oxide as a magnetic material dispersed in a polymer material (non-conductive material) as a base material. Magnet 10 with magnetic powder dispersed in the non-conductive polymer material has an electrical characteristic of low electric conductivity. Also this magnet 10 has a magnetic characteristic of a maximum energy product (BH max)=6.4 $kJ/m^3$.

Columnar magnet 10 having a diameter of 20 mm and a height of 28 mm has a magnetic flux density Gs of 45 mT (millitesla) at the surface of magnet 10. The magnetic flux density of 45 mT is equivalent to or less than the magnetic flux density of the surface of a magnet sheet for use as being affixed to, for example, a whiteboard at an office or the like, a refrigerator's door at home, and so forth. Magnetic marker 1 including this magnet 10 acts magnetism of approximately 8 μT or more in a range of height from 100 mm to 250 mm above the ground, which is a floor height of vehicle 3. For example, according to an MI sensor or the like with high accuracy having a magneto-impedance element, magnetism of magnetic marker 1 can be detected with high reliability.

Of outer peripheral surfaces of magnet 10, conductive layer 16 is formed on the end face as an attachment surface for RFID tag 2 and an outer peripheral side surface. Conductive layer 16 is a copper-plated layer made by metal plating and having a thickness of 0.03 mm. This conductive layer 16 is in contact with the outer peripheral surface of magnet 10. However, since magnet 10 has low electric conductivity as described above, conductive layer 16 is in a state of not being electrically in contact with the main body of magnet 10.

(RFID Tag)

RFID tag 2 (FIG. 4) is an electronic component configured to include antenna 23 made of metal (conductive material) by folding a narrow strip-shaped flat plate (omitted in the drawings) in an U shape and sheet-shaped tag 20. RFID tag 2 is formed of a block shape with three sides having dimensions A, B, and C in FIG. 4 of 12 mm, 7 mm, and 9 mm, respectively. In the present embodiment, one of surfaces defined by dimension A and dimension C serves as an attachment surface to magnet 10.

Tag 20 (FIG. 5) is an electronic component having IC (Integrated Circuit) chip 201 implemented on a surface of tag sheet 200 having a size of 2 mm×3 mm. IC chip 201, which is one example of a processing part for processing information superposed on electric waves in wireless communication, operates by electric power wirelessly supplied to RFID tag 2 and wirelessly outputs stored information as tag information. Tag 20 is preferably a wireless tag in the UHF band.

Tag sheet 200 is a sheet-shaped member cut out from a PET (PolyEthylene Terephthalate) film. On the surface of tag sheet 200, antenna 205 is formed, which is a printed pattern with conductive ink made of silver paste. Antenna 205 is formed of a ring shape with a notch, and a chip arrangement area (omitted in the drawings) for arranging IC chip 201 is formed in the notched portion. When IC chip 201 is bonded to tag sheet 200, antenna 205 is electrically connected to IC chip 201.

In tag 20, antenna 205 is in a state of being provided to electrically extend from IC chip 201. This antenna 205 has both a role as an antenna for power feeding to generate exciting current by external electromagnetic induction and a role as an antenna for communication to wirelessly transmit information.

In RFID tag 2, for example, by insert molding of injecting and curing a resin material, antenna 23 forming the U shape is retained in resin in a landscape state (refer to FIG. 4). Of the dimensions of block-shaped RFID tag 2, only dimension B (refer to FIG. 6) corresponding to the lateral width of the U shape formed by antenna 23 matches the corresponding dimension of antenna 23. The other dimensions A and C are larger than those of antenna 23. In RFID tag 2, paired flat plate parts 231 facing each other via gap 230 of U-shaped antenna 23 are exposed so as to be flush with outer surfaces of block-shaped RFID tag 2, respectively. In RFID tag 2 of the present embodiment, paired flat plate parts 231 arranged to face each other via gap 230 are one example of any two waveguide parts included in antenna 23. In RFID tag 2 of the present embodiment, as in FIG. 6, antenna gap G, which is a distance of gap 230 where paired flat plate parts 231 face each other, is 5 mm.

In RFID tag 2, sheet-shaped tag 20 is retained in resin. Sheet-shaped tag 20 is arranged so as to face bottom surface 233 inside of the U shape formed by antenna 23. Between tag 20 and antenna 23, a gap is provided, and both are in a state of not being electrically in contact with each other and being electrically insulated via resin. In RFID tag 2, antenna 205 of tag 20 provided to electrically extend from IC chip 201 functions as a primary antenna. Antenna 205 is coupled to antenna 23 by electrostatic coupling, electromagnetic coupling, or the like in an electrically non-contact state. Antenna 23 functions as an antenna which mediates electric waves transmitted and received by antenna 205 of tag 20 and amplifies the electric waves to enhance radio field intensity.

Note that as for an arrangement position of tag 20 in RFID tag 2, tag 20 is preferably required to be positioned inside antenna 23 having a U-shaped-cross section. For example, sheet-shaped tag 20 may be retained so as to face either one of flat plate parts 231 of antenna 23 facing each other. Furthermore, for example, sheet-shaped tag 20 may be retained so as to be orthogonal to bottom surface 233 of U-shape and also orthogonal to flat plate parts 231 facing each other.

In place of RFID tag 2 (refer to FIG. 6) in which the gap is provided between tag 20 and antenna 23 and both are in the state of being electrically insulated via resin, RFID tag in which antenna 205 incorporated in tag 20 and antenna 23 are electrically in contact with each other may be adopted. In this case, antenna 205 of tag 20 electrically makes contact with conductive layer 16 via antenna 23.

(Magnetic Marker)

Magnetic marker 1 (FIG. 1) is assembled by combining RFID tag 2 and magnet 10. RFID tag 2 is attached to the end face of magnet 10 via a surface where flat plate part 231 of antenna 23 having the U-shaped cross section is exposed. Attachment of RFID tag 2 may be chemical bonding such as, for example, adhesive bonding using a conductive adhesive; physical bonding such as ultrasonic metal bonding by shaking RFID tag 2 by ultrasonic vibration for bonding; or mechanical bonding such as screwing.

As described above, conductive layer 16 is formed on the end face of magnet 10 forming the attachment surface for RFID tag 2. On the other hand, in RFID tag 2, antenna 23 is exposed on the attachment surface to magnet 10. Therefore, with RFID tag 2 bonded to the end face of magnet 10 as described above, it brings into a state that antenna 23 electrically makes contact with conductive layer 16. Therefore, conductive layer 16 of magnetic marker 1, together with antenna 23, functions as an external antenna of antenna 205 incorporated in tag 20.

Note that on a surface opposite to the attachment surface of RFID tag 2, flat plate part 231 (antenna 23) is externally exposed outside so as to be flush with the surface. Therefore, in magnetic marker 1, flat plate part 231 opposite to flat plate part 231 on the side in contact with magnet 10 is in a state of forming part of the outer surface and being exposed outside.

As described above, a length (height) of columnar magnet 10 configuring magnetic marker 1 in an axial direction is 28 mm. Also, a length (height, dimension B in FIG. 4) of RFID tag 2 in the axial direction attached to the end face of magnet 10 in the axial direction is 7 mm. Therefore, an overall length (height) of magnetic marker 1 in the axial direction is 35 mm. A diameter of magnetic marker 1 is 20 mm, which is equal to the diameter of magnet 10.

Here, as for magnetic marker 1 with the RFID tag, the inventors have conducted various tests regarding communication performance of RFID tag 2. The tests include submersion tests for measuring communication performance in a state in which magnetic marker 1 is submerged in water, and so forth. And, through these tests, the inventors have found that water adversely influences communication performance of RFID tag 2.

To address this, the inventors have conducted submersion tests in a state in which resin mold 4 (FIG. 7) covering RFID tag 2 in a fluid-tight state is attached to an end face of magnetic marker 1. Resin mold 4 is formed by using, for example, a cylindrical mold (omitted in the drawings) capable of accommodating magnetic marker 1 without a gap. For example, resin mold 4 exemplarily depicted in FIG. 7 can be formed by, for example, after inpouring a non-conductive resin material into an open end on RFID tag 2 side of open ends of the cylindrical mold, waiting until the resin material is cured, and then extracting magnetic marker 1 from the mold.

Note that the inventors have confirmed in advance by another communication test performed prior to the submersion tests that influences on communication performance are less if formation material of the resin mold is a non-conductive material. Thus, in the present embodiment, an epoxy resin is adopted as the formation material of resin mold 4. As the formation material of the resin mold, in addition to the epoxy resin, any of resin materials such as silicone resin and polymer materials such as asphalt may be used.

As a result of the submersion tests, it has been confirmed that degradation in communication performance may occur even if resin mold 4 of FIG. 7 is provided so as to cover RFID tag 2. The inventors have considered the following reason for the degradation in communication performance.

(Reason for Degradation in Communication Performance)

When a periphery is submerged in water and water makes contact with an outer surface of resin mold 4, a boundary surface of water in contact with the outer surface of resin mold 4 is formed. Since this boundary surface of water faces flat plate part 231, a structure similar to an antenna structure due to a face-to-face structure of paired flat plate parts 231 is formed also between flat plate part 231 and the boundary surface of water. In this case, part of energy of electric waves acts on a face-to-face structure between flat plate part 231 and the boundary surface of water, and energy of electric waves received by the antenna structure formed by paired flat plate parts 231 decreases. Then, energy of electric waves acting on the face-to-face structure formed by the boundary surface of water is converted to eddy current occurring in water or the like and consumed to produce energy losses.

In view of this reason for degradation in communication performance, the inventors have paid attention to a possibility that communication performance depends on a length of a distance at which flat plate part 231 and the boundary surface of water face each other. Thus, the inventors have conducted submersion tests of a plurality of types by taking a thickness of resin mold 4 functioning as a protecting part which isolates antenna 23 from water, that is, a distance between the surface of RFID tag 2 (the surface of flat plate part 231) and the outer surface of resin mold 4, as a parameter. Note in the following description that the distance as the parameter is referred to as isolation distance Gw (refer to FIG. 7) with which antenna 23 can be isolated from water.

By analyzing or evaluating the test results of the submersion tests by taking isolation distance Gw as the parameter, the inventors have found that a strong correlation is present between isolation distance Gw from water to antenna 23 and antenna gap G, which is the distance of gap 230 of antenna 23 (refer to FIG. 8).

FIG. 8 exemplarily depicts results of evaluation of communication performance when the submersion test was performed for each combination between antenna gap G and isolation distance Gw. In these submersion tests, an error rate when wireless communication is performed by tag reader unit 36 set at a position one meter directly above submerged magnetic marker 1 is measured. Evaluations of communication performance A+, A, A−, and B in the drawing each represents the degree of the error rate in an easy-to-understand manner. A+ indicates such a degree of the error rate that tag reader unit 36 and RFID tag 2 can communicate without problems. A indicates such a degree of the error rate that communication can be performed without problems although the error rate is higher than that of A+. A− indicates such a degree of the error rate that communication can be performed to a certain extent but may not be able to be performed in accordance with changes in an external environment and so forth. B indicates such a degree of the error rate that stable communication cannot be achieved.

In the results of evaluation of communication performance in FIG. 8, it is significant that communication tends to be unstable when isolation distance Gw is smaller than antenna gap G. On the other hand, when isolation distance Gw is larger than antenna gap G, communication tends to be stable. Based on the drawing, it can be found that as isolation distance Gw, a value equal to antenna gap G or exceeding antenna gap G is preferably set.

Note that the inventors have performed, as another submersion test, a test by taking a thickness of resin mold 4 in a radial direction corresponding to an outer perimeter of antenna 23 as a parameter. As a result, it has been confirmed that compared with the thickness of resin mold 4 in a facing direction of flat plate parts 231, that is, isolation distance Gw in FIG. 7, a degree of influences on communication performance by the thickness of resin mold 4 in the radial direction is small. However, since these influences are not zero, it is preferable to ensure that the thickness of resin mold 4 in the radial direction corresponding to the outer perimeter of antenna 23 is equivalent to or thicker than antenna gap G.

(2) Magnetic Marker Installation Method

Magnetic marker 1 is, for example, accommodated and buried in accommodation hole 31 provided to be bored in road surface 30S (refer to FIG. 2). Generally speaking, in paving materials such as asphalt for use in paving road surface 30S, gravel and so forth are used as an aggregate. Thus, an innumerable number of holes are formed on road surface 30S and inside road surface 30S, and there is a high possibility that rain water and so forth may permeate via these holes.

As described above, in magnetic marker 1, flat plate part 231 is flush with the outer surface of RFID tag 2 and is exposed to outside. Thus, after magnetic marker 1 is accommodated in accommodation hole 31, only with backfilling the hole with a paving material, there is a high possibility that a situation occurs in which the periphery of magnetic marker 1 is submerged in water penetrating from road surface 30S and water is attached to antenna 23 of RFID tag 2 (isolation distance Gw is zero).

By contrast, one of technical features of the method of installing magnetic marker 1 of the present embodiment is that isolation distance Gw=7 mm longer than antenna gap G=5 mm is ensured at a time of installation. In the following, a procedure of installing magnetic marker 1 to ensure isolation distance Gw=7 mm is described with reference to a flowchart of FIG. 9 and FIG. 10.

To install magnetic marker 1, first, as in FIG. 10(*a*), accommodation hole 31 is provided to be bored (formed) (S101). This accommodation hole 31 is a hole for accommodating magnetic marker 1 in a state in which the axial direction of magnetic marker 1 matches the vertical direction. As described above, length (height including RFID tag 2) S of magnetic marker 1 in the axial direction is 35 mm, and the diameter is 20 mm. Inner diameter E of accommodation hole 31 can be any to the extent that magnetic marker 1 having the diameter of 20 mm can be accommodated. On the other hand, depth F of accommodation hole 31 is 42 mm obtained by adding 7 mm to 35 mm so that protecting part 40 (refer to FIG. 10(*d*)) with isolation distance Gw of 7 mm can be formed above magnetic marker 1.

In this accommodation hole 31, magnetic marker 1 is accommodated, with an end face on a side where RFID tag 2 is not provided facing downward (S102, arrangement step, FIG. 10(*b*)). Since accommodation hole 31 has the depth of 42 mm, by accommodating magnetic marker 1 so that a gap is not produced on a bottom side, a gap of 7 mm is formed above magnetic marker 1 (FIG. 10(*c*)). Here, as described above, RFID tag 2 is positioned on an upper end part of magnetic marker 1. Flat plate part 231 forming antenna 23 of RFID tag 2 is flush with the outer surface of RFID tag 2. Therefore, when magnetic marker 1 is accommodated in accommodation hole 31 as described above, a gap between flat plate part 231 positioned on the upper end part of magnetic marker 1 and road surface 30S is 7 mm.

Accommodation hole 31 having magnetic marker 1 accommodated therein is filled with asphalt (one example of a polymer material) in a molten state without admixture of aggregate (S103, FIG. 10(*d*)). Then, with the filled asphalt being cooled and dried, in a state in which protecting part 40 made of asphalt is formed so as to cover RFID tag 2, installation of magnetic marker 1 can be completed (S104, formation step).

According to the above-described method of installing magnetic marker 1, when magnetic marker 1 is installed, protecting part 40 which isolates antenna 23 of RFID tag 2 from water can be formed. In particular, in the installation method of the present embodiment, in consideration of the results of evaluation of communication performance of FIG. 8, with respect to antenna gap G (5 mm) of RFID tag 2 included in magnetic marker 1, protecting part 40 achieving isolation distance Gw (7 mm) with which the result of evaluation of communication performance is A+ is formed.

By forming protecting part 40 on magnetic marker 1 at the time of installation, even if the periphery is submerged in water, antenna 23 can be sufficiently isolated from water, and high communication performance can be kept. Therefore, by installing magnetic marker 1 with the installation method of the present embodiment, even under a rainy environment or the like, wireless communication with vehicle 3 can be achieved with high reliability. Note that, of the surfaces of RFID tag 2, on the surface side in contact with magnet 10, magnet 10 itself functions as the protecting part. On this surface side, antenna 23 is isolated from water by magnet 10 itself.

In the present embodiment, as accommodation hole 31 of magnetic marker 1, exemplarily described is the hole having the diameter to the extent that magnetic marker 1 can be accommodated and having the depth of 42 mm. According to this accommodation hole 31, as described above, the gap between flat plate part 231 of magnetic marker 1 and road surface 30S can be set at 7 mm. As for accommodation hole 31, the hole may have a depth exceeding 42 mm. Furthermore, the accommodation hole in a two-stage structure may be adopted. A deeper hole on the first stage preferably has a diameter to the extent that magnetic marker 1 can be accommodated and has a depth to the extent of the height of magnetic marker 1. A hole on the second stage opening to road surface 30S preferably has a one size larger diameter than that of magnetic marker 1 and a depth on the order of 7 mm to 12 mm. According to the accommodation hole in the two-stage structure, protecting part 40 having the diameter larger than that of magnetic marker 1 can be formed.

While conductive layer 16 is provided directly on the outer peripheral surface of magnet 10 forming the main body in the present embodiment, the protecting part for preventing proximity of water may be provided on an outer perimeter of this conductive layer 16.

In the present embodiment, asphalt, which is a polymer material, is exemplarily described as a material for forming protecting part 40. As the material for forming protecting part 40, in addition to asphalt, any of resin materials such as epoxy resin and silicone resin may be used. Furthermore, a composite material with fiber such as glass fiber mixed into a polymer material or a resin material may be used. Alternatively, silicone rubber may be used, or a polymer material forming a base material of the ferrite plastic magnet or the ferrite rubber magnet may be used.

A resin layer made of a resin material may be formed on an outer perimeter of magnet 10, and the conductive layer may be provided outside that resin layer. Alternatively, the outer perimeter of magnet 10 provided with conductive layer 16 may be coated with a resin material, and RFID tag 2 may be arranged on a surface of a coating layer. In place of conductive layer 16, which is a plated layer, a conductive layer with metal foil or the like may be provided.

Note that, as in FIG. 11, protective member 401 having the same shape as that of protecting part 40 in FIG. 10(*d*) may be prepared in advance. As protective member 401, for example, a molded component made of a resin material such as epoxy, a polymer material such as asphalt, or the like can be adopted. For example, protective member 401 is preferably bonded or the like to the end face of magnetic marker 1 accommodated in accommodation hole 31 by using, for example, an adhesive. Alternatively, magnetic marker 1 having protective member 401 attached thereto in advance may be accommodated in accommodation hole 31. This protective member 401 functions as the protecting part which isolates antenna 23 of RFID tag 2 from water.

As a material for forming protective member 401, in addition to the above, any of the following materials may be used: a resin material such as PP (PolyPropylene) or PET; silicone resin; silicone rubber; a ferrite plastic magnet or a ferrite rubber magnet, which is made of the same material as that of the main body of magnet 10; a polymer material forming the base material of the ferrite plastic magnet or the ferrite rubber magnet; and so forth.

In place of RFID tag 2 of the present embodiment, the sheet-shaped tag (reference sign 20 in FIG. 4) configuring this RFID tag 2 itself may be used as an RFID tag and be combined with the external antenna. In magnetic marker 1 exemplarily depicted in FIG. 12, on one end face of columnar-shaped magnet 10, substantially circular metal foil 24 having a diameter of 12 mm is affixed and sheet-shaped tag 20 (which is referred to as RFID tag 20 as appropriate) is retained. Substantially circular metal foil 24 is provided with slit-shaped gap 240 passing through a center of metal foil 24, with only one end part communicating with outside. On metal foil 24, two areas 241 facing each other via gap 240 having a width of 3 mm are formed. These two areas 241 are coupled together on a bottom side corresponding to the other end part of gap 240, and are connected together without being separated.

On the other end part corresponding to a depth side (bottom side) of slit-shaped gap 240, sheet-shaped RFID tag 20 with a size of 2 mm×3 mm is arranged. Metal foil 24 is coupled to an antenna (primary antenna, reference sign 205 in FIG. 5) of RFID tag 20 in an electrically noncontact state by electrostatic coupling, electromagnetic coupling, or the like, and functions as the external antenna. Two areas 241 facing via gap 240 form one example of waveguide parts arranged to face each other across gap 240. In RFID tag 20 using metal foil 24 as the external antenna, the width of 3 mm of gap 240 between two areas 241 is antenna gap G. Also for magnetic marker 1 exemplarily depicted in FIG. 12, by an installation method similar to that of the present embodiment, the protecting part is preferably provided to the end face side where RFID tag 20 is arranged. Isolation gap Gw formed by the protecting part preferably has a dimension equal to or more than antenna gap G=3 mm.

Second Embodiment

The present embodiment is an example of a method of installing magnetic marker 1 based on the magnetic marker of FIG. 12 exemplarily depicted as a modification example in the first embodiment, with a change of the arrangement location of RFID tag 20 from the end face to the outer peripheral side surface of the magnet. Details of this are described with reference to FIG. 13 to FIG. 18.

In magnetic marker 1 of the present embodiment, as in FIG. 13, metal foil 25 provided with slit-shaped gap 250 is arranged so as to be wound around the outer peripheral side surface of magnet 10 and sheet-shaped RFID tag 20 is arranged in that slit-shaped gap 250. Metal foil 25 is formed of a laterally-elongated, substantially-rectangular shape, as in a development view of FIG. 14, with the lateral-width dimension being shorter than the periphery length of magnet 10. Therefore, when this metal foil 25 is formed so as to be wound around magnet 10, the length of the metal foil is insufficient for an entire periphery of magnet 10, and the state is such that a gap is formed at one location in a circumferential direction.

As in the development view of FIG. 14, in laterally-elongated, substantially-rectangular-shaped metal foil 25, slit-shaped gap 250 extending in a longitudinal direction with only one end part being open to outside is formed. In this metal foil 25, two areas 251 facing each other via gap 250 having a width of 3 mm are formed. These two areas 251 are coupled together on a bottom side corresponding to the other end part of gap 250 and are connected without being separated.

On the other end part corresponding to a depth side (bottom side) of slit-shaped gap 250, sheet-shaped RFID tag 20 with a size of 2 mm×3 mm is arranged. Metal foil 25 is coupled to the antenna (primary antenna, reference sign 205 in FIG. 5) of RFID tag 20 in the electrically noncontact state by electrostatic coupling, electromagnetic coupling, or the like, and functions as the external antenna, as in the above-described first mode. Two areas 251 facing each other via gap 250 form one example of waveguide parts arranged to face each other across gap 250. In RFID tag 20 using metal foil 25 as the external antenna, the width of 3 mm of gap 250 between two areas 251 is antenna gap G.

Next, a procedure of installing this magnetic marker 1 is described.

As with the first embodiment, to install magnetic marker 1, first, accommodation hole 311 is provided to be bored in road surface 30S (FIG. 15(*a*)). Circular bottom surface 312 of this accommodation hole 311 is provided with concentric circular deep bottom surface 313, and the bottom surface of accommodation hole 311 thereby has a two-stage structure. This accommodation hole 311 can be formed by, for example, boring a hole having a depth of 30 mm by a drill having an outer shape of 20 mm or the like and then boring a hole having a depth of 26 mm by a drill having an outer shape of 30 mm or the like.

Of the bottom surfaces of accommodation hole 311 in the two-stage structure, when magnetic marker 1 is accommodated so as to make contact with deeper bottom surface 313 (FIG. 15(*b*)→FIG. 15(*c*), arrangement step), a cylindrical gap having a thickness of 5 mm can be formed between an inner peripheral surface of accommodation hole 311 and an outer peripheral side surface of magnetic marker 1 (FIG. 15(*c*)). When this cylindrical gap is filled with asphalt (one example of a polymer material) in a molten state and is cooled, dried, and so forth, cylindrical protecting part 43 made of asphalt can be formed (FIG. 15(*d*), formation step). Note that an upper surface side of magnetic marker 1 is preferably covered with a paving material as appropriate.

According to the installation procedure in series depicted in FIG. 15, a state can be formed such that cylindrical protecting part 43 made of asphalt and having a thickness of 5 mm is mounted on and arranged to the outside of magnetic marker 1. According to this protecting part 43, as isolation distance Gw for isolating metal foil 25 functioning as the external antenna from water, 5 mm can be ensured, which exceeds antenna gap G=3 mm.

In particular, in the installation procedure of the present embodiment, with magnetic marker 1 arranged on deep bottom surface 313 of two-stage-bottomed accommodation hole 311, adjustment of center position of magnetic marker 1 (concentric arrangement of magnetic marker 1 in accommodation hole 311, centering) is achieved with high reliability. By centering of magnetic marker 1 in accommodation hole 311 with high accuracy, the thickness of protecting part 43 in the radial direction can be made uniform, and this allows isolation distance Gw=5 mm to be achieved in an entire area of magnetic marker 1 in the circumferential direction.

Note that, as in FIG. 16, protective member 431 having the same shape as that of protecting part 43 in FIG. 15 may be fabricated in advance by molding a resin material or the like. For example, after magnetic marker 1 is accommodated in accommodation hole 311, protective member 431 may be mounted on and arranged to the outside of magnetic marker 1. Alternatively, magnetic marker 1 having protective member 431 attached thereto in advance may be accommodated in accommodation hole 311. Note that this protective member 431 is required to be attached to magnetic marker 1 in a fluid-tight state. Also, the end face of magnetic marker 1 exposed inside cylindrical protective member 431 is preferably protected by being covered with a paving material or the like.

As in FIG. 17, as for the shape of accommodation hole 311, instead of the bottom surface in the two-stage structure, an mortar-shaped bottom surface may be adopted. With the bottom surface recessed in a mortar-shape, adjustment of center position (centering) of magnetic marker 1 in accommodation hole 311 can be made. Also as in FIG. 18, flange shape 109 like a flange of a hat may be provided to a lower part of magnetic marker 1. According to flange shape 109 projecting from the outer perimeter of magnetic marker 1, centering magnetic marker 1 in accommodation hole 311 can be made with high reliability.

Note that other configurations and operations and effects are similar to those of the first embodiment.

Third Embodiment

The present embodiment is an example based on the first embodiment, with a change to a sheet-shaped magnetic marker 1. Details of this are described by using FIG. 19 to FIG. 21.

Magnetic marker 1 of the present embodiment retains sheet-shaped RFID tag 27 on a surface of magnet sheet 10, as in FIG. 19.

Magnetic marker 1 is a marker that is formed of a flat circular shape having a diameter of 100 mm and a thickness of 1.5 mm and can be adhesively bonded to a road surface. Magnet sheet 10 forming this magnetic marker 1 is made by forming an isotropic ferrite rubber magnet having a maximum energy product (BH max)=6.4 kJ/m$^3$ into a sheet shape.

As in FIG. 20, by adopting antenna 272 of a pattern being wound in a spiral shape, RFID tag 27 has its antenna performance enhanced. RFID tag 27 is formed of a sheet shape with a size of 3 mm×4 mm. This RFID tag 27 does not require an external antenna, and can singly communicate with a vehicle side. In RFID tag 27, gap 270 of spiral-shaped antenna 272 serves as antenna gap G. In this RFID tag 27, this antenna gap G is 0.5 mm.

Next, a procedure of installing magnetic marker 1 of the present embodiment is described by using FIG. 21.

To install magnetic marker 1, first, sheet-shaped magnetic marker 1 is arranged on road surface 30S on which an adhesive such as asphalt is applied (FIG. 21(*a*)→(b), arrangement step). Then, for example, by using an installation instrument such as a stamp which discharges asphalt in a molten state, protective layer 45 with asphalt is provided on the surface of magnetic marker 1 arranged on road surface 30S (FIG. 21(*c*)→(d), formation step). Protective layer 45 is provided so as to cover RFID tag 27 with a thickness on the order of 1 mm, which exceeds antenna gap G=0.5 mm. This protective layer 45 functions as the protecting part which isolates antenna 272 from water, and isolation distance Gw=approximately 1 mm can be achieved. Note that as for a back surface side (road surface 30S side) of magnetic marker 1, magnetic marker 1 (magnet sheet 10) having a thickness of 1.5 mm itself functions as the protecting part (isolation distance is 1.5 mm) which isolates antenna 272 from water.

Protective layer 45 may be formed on an entire surface of magnetic marker 1. Furthermore, in place of protective layer 45 with asphalt, for example, a protective seal made of PP (PolyPropylene) having an adhesive applied to a back surface may be bonded to the surface of magnetic marker 1 to cover RFID tag 27.

In place of RFID tag 27 of FIG. 19, a combination of metal foil 24 which functions as the external antenna and sheet-shaped RFID tag 20 in FIG. 12 of the first embodiment may be arranged on the surface of magnetic marker 1. As described above, antenna gap G when this configuration is adopted is 3 mm. In this case, a layer forming the protecting part is required to be provided not only on a front surface side but also on the back surface side (road surface 30S side) of magnetic marker 1.

To install this magnetic marker 1, it is preferable that an asphalt layer not containing an aggregate is formed on road surface 30S in advance or a large-format sheet made of PP is affixed to road surface 30S in advance. This asphalt layer or the large-format sheet, serving as a seat for magnetic marker 1 preferably has a thickness on the order of 3 mm. A combination of the asphalt layer or the large-format sheet of 3 mm and magnetic marker 1 having a thickness of 1.5 mm, functions as the protecting part (isolation distance Gw=4.5 mm) which isolates the antenna from water. On the front surface side of magnetic marker 1, the layer-like protecting part having a thickness of 5 mm is preferably provided. As the layer-like protecting part, for example, in addition to the asphalt layer, a protective sheet made of a resin material such as PP may be used.

Note that other configurations and operations and effects are similar to those of the first embodiment.

In the foregoing, specific examples of the present invention are described in detail as in the embodiments, these specific examples merely disclose examples of technology included in the scope of the claims. Needless to say, the scope of the claims should not be restrictively construed based on the configuration, numerical values, and so forth of the specific examples. The scope of the claims includes techniques acquired by variously modifying, changing, or combining as appropriate the above-described specific examples by using known techniques, knowledge of a person skilled in the art, and so forth.

REFERENCE SIGNS LIST

1 magnetic marker
10 magnet (main body)
16 conductive layer
2 RFID tag (wireless tag)
20 tag (electronic component)
201 IC chip (processing part)
205 antenna (primary antenna)
23 antenna
230 gap
231 flat plate part (waveguide part)
3 vehicle
35 magnetic sensor unit
36 tag reader unit
30S road surface
31 accommodation hole
4 resin mold
40, 43 protecting part
401, 431 protective member (protecting part)
45 protective layer (protecting part)

The invention claimed is:

1. A magnetic marker installation method for laying, in or on a road, a magnetic marker having retained therein a wireless tag including an antenna for transmitting or receiving electric waves for wireless communication, the installation method comprising:

an arrangement step of arranging the magnetic marker in or on the road; and a formation step of providing the magnetic marker with a protecting part for isolating the antenna from water, wherein the antenna includes waveguide parts made of a conductive material and a gap formed by any two of the waveguide parts arranged to face each other, and the formation step is a step of providing the magnetic marker with the protecting part so that a distance for isolating the antenna from water is longer than the gap.

2. The magnetic marker installation method according to claim 1, wherein the wireless tag has an electronic component including a processing part for processing information to be superposed on the electric waves and a primary antenna provided to electrically extend from the processing part, and the electronic component is arranged in the gap.

3. The magnetic marker installation method according to claim 2, wherein the protecting part to be provided to the magnetic marker in the formation step is made of a polymer material.

4. The magnetic marker installation method according to claim 3, wherein the arrangement step is a step of accommodating the magnetic marker in an accommodation hole provided to be bored in a road surface of the road, and the formation step is performed after the arrangement step is performed.

5. The magnetic marker installation method according to claim 2, wherein the arrangement step is a step of accommodating the magnetic marker in an accommodation hole provided to be bored in a road surface of the road, and the formation step is performed after the arrangement step is performed.

6. The magnetic marker installation method according to claim 1, wherein the protecting part to be provided to the magnetic marker in the formation step is made of a polymer material.

7. The magnetic marker installation method according to claim 6, wherein the arrangement step is a step of accommodating the magnetic marker in an accommodation hole provided to be bored in a road surface of the road, and the formation step is performed after the arrangement step is performed.

8. The magnetic marker installation method according to claim 1, wherein the arrangement step is a step of accommodating the magnetic marker in an accommodation hole provided to be bored in a road surface of the road, and the formation step is performed after the arrangement step is performed.

* * * * *